US006699065B1

(12) United States Patent
Espenshade et al.

(10) Patent No.: US 6,699,065 B1
(45) Date of Patent: Mar. 2, 2004

(54) ELECTRICAL CONNECTOR WITH LEDS MOUNTED ON AN INTERNAL PCB

(75) Inventors: Leonard K. Espenshade, Harrisburg, PA (US); James H. Hyland, Hummelstown, PA (US)

(73) Assignee: Hon Hai Precision Ind, Co., Ltd., Taipei Hsien (TW)

( * ) Notice: Subject to any disclaimer, the term of this patent is extended or adjusted under 35 U.S.C. 154(b) by 0 days.

(21) Appl. No.: 10/318,694

(22) Filed: Dec. 12, 2002

(51) Int. Cl.[7] ..... H01R 3/00
(52) U.S. Cl. ..... 439/490; 439/620
(58) Field of Search ..... 439/620, 541.5, 439/489, 490, 607, 609, 76.1, 676

(56) References Cited

U.S. PATENT DOCUMENTS 5,700,157 A 12/1997 Chung
5,876,239 A 3/1999 Morin et al.
6,116,946 A 9/2000 Lewis et al.
6,227,911 B1 5/2001 Boutros et al.
6,428,361 B1 8/2002 Imschweiler et al.
6,457,993 B1 * 10/2002 Espenshade ..... 439/490
6,478,610 B1 * 11/2002 Zhou et al. ..... 439/490
6,488,529 B1 * 12/2002 Chen ..... 439/490

* cited by examiner

*Primary Examiner*—Gary Paumen
(74) *Attorney, Agent, or Firm*—Wei Te Chung

(57) ABSTRACT

An electrical connector (100) for being mounted to a mother PCB includes an insulative housing (1) defining at least one receiving slot (11, 12) for receiving at least one mating connector, a plurality of conductive terminals (31) received in the insulative housing and extending into the receiving slot, and an LED subassembly (4) attached to the housing. The LED subassembly includes an internal PCB (41), which is electrically isolated from the conductive terminals before being mounted to the mother PCB, and a pair of LEDs (40), which are electrically mounted to the internal PCB and which terminate to the mother PCB via the internal PCB.

1 Claim, 4 Drawing Sheets

ELECTRICAL CONNECTOR WITH LEDS MOUNTED ON AN INTERNAL PCB

CROSS-REFERENCE TO RELATED APPLICATION

This application is related to a co-pending U.S. Patent application entitled "STACKED ELECTRICAL CONNECTOR HAVING EASILY DETACHABLE ELECTRONIC MODULE", invented by Leonard K. Espenshade and Kevin E. Walker, with a Ser. No. 10/236,614, which is assigned to the common assignee.

BACKGROUND OF THE INVENTION

1. Field of the Invention

The present invention relates to the field of electrical connectors and in particular to an electrical connector with LEDs exposed at a mating face thereof for providing a visible indication of the connection between the electrical connector and a mating connector.

2. Description of the Related Art

Electrical connectors, such as Modular jacks, usually use LEDs for indicating an electrical connection with a mating plug. There are several means of mounting the LEDs to the electrical connectors. U.S. Pat. No. 5,613,873 issued to Bell, Jr. on Mar. 25, 1997 discloses a conventional modular jack with a pair of integral LEDs. The modular jack has a jack housing defining a recess in a front face and a pair of passageways extending from the recess to a back face. A light-emitting portion of each LED is received in the recess and a pair of electrical leads of each LED is inserted through corresponding passageways and is bent to be mounted on a mother PCB. However, inserting the electrical leads, which have little rigidity, through the long passageways is a difficult process, and replacing burned out LEDs will be difficult.

U.S. Pat. No. 6,227,911 issued to Boutros et al. on May 8, 2001 solves the above problem by using an LED sub-module attached to a rear portion of a jack housing. A pair of LEDs is mounted on the sub-module and extends to a mating face of the housing. The electrical leads from the LEDs extend downwardly close to and substantially parallel with contact leads of the connector before they are secured to a mother PCB. Since LEDs generate a significant amount of electrical noise, the proximity of the LED leads to the connector contact leads could adversely affect data transmitted through the connector.

U.S. Pat. 6,428,361 issued to Imschweiler et al. on Aug. 6, 2002 teaches a related modular jack using a PCB attached to a rear portion of a jack housing. A pair of LEDs, together with contacts and toroids for filtering applications, are mounted on the PCB and terminate to a mother PCB via wiring patterns on the PCB. However, attachment of the LEDs to the same jack PCB contributes to crowding of circuit traces, and fails to mitigate noise from the LEDs since the LED electrical traces are still very near those of the connector contacts.

Hence, an electrical connector with improved LED mounting means is needed to overcome the foregoing shortcomings.

BRIEF SUMMARY OF THE INVENTION

A main object of the present invention is to provide a compact electrical connector with LEDs.

Another object of the present invention is to provide an electrical connector having improved performance.

An electrical connector for being mounted to a mother PCB includes an insulative housing defining at least one receiving slot for receiving at least one mating connector, a plurality of conductive terminals received in the insulative housing and extending into the at least one receiving slot, and an LED subassembly attached to the housing. The LED subassembly includes a pair of LEDs and an internal PCB to which the LEDs are mounted. The internal PCB is separately connected to the mother PCB, so the LED circuitry is electrically isolated from the conductive terminals before their connection to the mother PCB.

Other objects, advantages and novel features of the invention will become more apparent from the following detailed description when taken in conjunction with the accompanying drawings.

DETAILED DESCRIPTION OF THE INVENTION

Figure 1:
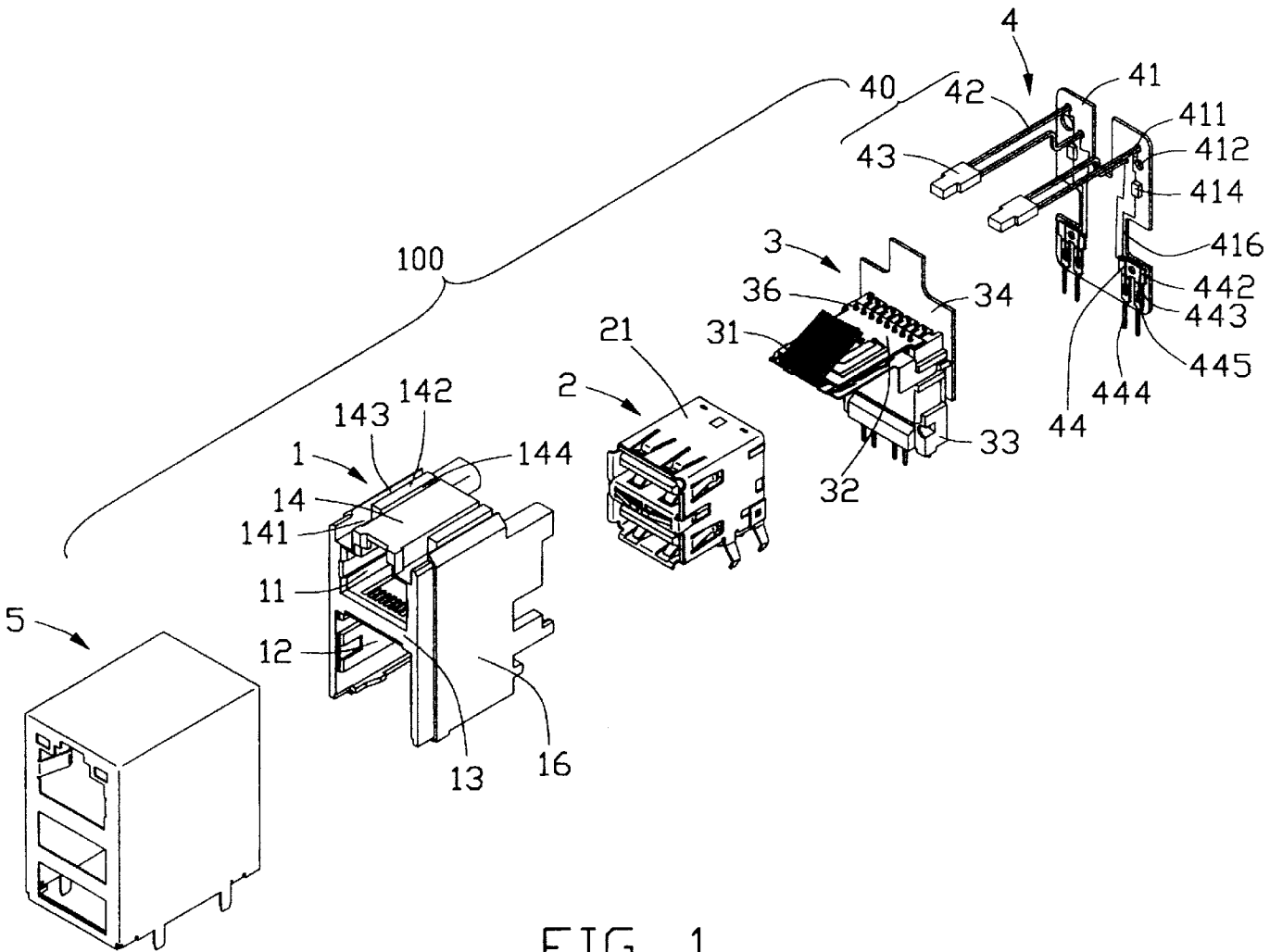
FIG. 1 is an exploded view of a connector according to the present invention.
Figure 2:
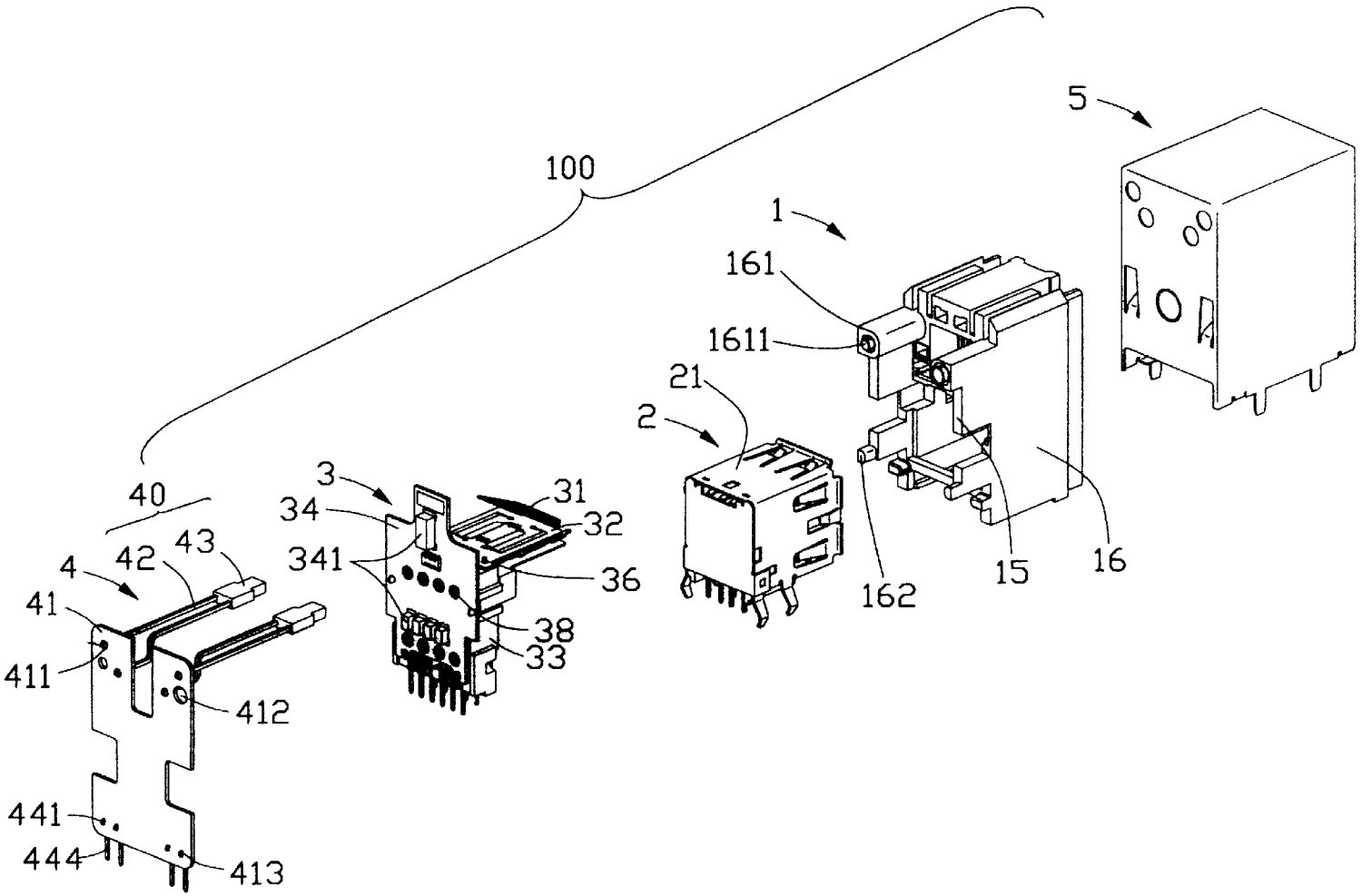
FIG. 2 is another exploded view of the connector of FIG. 1 viewed from a rear aspect.

Referring to FIGS. 1 and 2, a stacked Local Area Network (LAN) connector 100, for mounted on a mother PCB (not shown), includes an insulative housing 1, a shielded Universal Serial Bus (USB) connector 2, a modular jack subassembly 3, an LED subassembly 4, and a shield 5 substantially surrounding the housing 1.

The insulative housing 1 includes a front mating face 13, a rear face 15 opposite to the mating face 13, a lower mounting face (not shown), a top wall 14, and opposite side walls 16. The housing 1 defines an upper and a lower receiving slots 11, 12 exposed to the mating face 13 in a stacked arrangement. A pair of longitudinal slots 141 is defined in the top wall 14 and respectively adjacent to a corresponding side wall 16. A partition 142 is defined in a rear portion of each slot 141 and divides the rear portion of the slot 141 into a first and a second channels 143, 144. An upper and a lower mounting portions 161, 162 extend rearwardly from each side wall 16. Rear faces of the upper and lower mounting portions 161, 162 are in a same vertical plane and are spaced from the rear face 15. A mounting post 1611 extends rearwardly from each upper mounting portion 161. The mounting posts 1611 are preferably cylindrical and have different diameters.

The shielded USB connector 2 has an insulative base member (not labeled), a plurality of conductive terminals (not labeled) received in the base member for electrically engaging with mating connectors, and an internal shield 21 substantially surrounding the base member.

The modular jack subassembly 3 includes a horizontal compensation PCB 32, a plurality of parallel conductive terminals 31 surface mounted on circuit traces (not labeled) of the compensation PCB 32, a daughter PCB 34 and a magnetic module 33. The daughter PCB 34 incorporates circuit traces (not shown) and plurality of electronic components 341, such as resistors and capacitors, connected with the circuit traces. The magnetic module 33 carries magnetic coils (not shown) and conductors 36, 38 electrically connected with the magnetic coils. One end of each conductor 36 electrically connects with a circuit trace of the compensation PCB 32 and one end of each conductor 38 electrically connects to a circuit trace of the daughter PCB 34, thereby electrically connecting the conductive terminals 31 with the magnetic coils and the conductive terminals 31 with the circuit traces of the daughter PCB 34, whereby the magnetic module 33 and the daughter board 34 act as a first and second noise suppressing modules for signal conditioning.

The LED subassembly 4 includes an internal PCB 41, a pair of LEDs 40 mounted on an upper portion of the internal PCB 41 and a pair of foot contacts 44 mounted on a lower portion of the internal PCB 41. The internal PCB 41 incorporates two pairs of circuit traces 416 therein and a pair of mounting holes 412 in an upper portion thereof. Upper and lower ends of each circuit trace 416 respectively terminate at an upper and a lower plated through holes 411, 413. Each pair of circuit traces 416 includes an electronic element, such as a resistor 414, therein. The mounting holes 412 have different diameters for respectively engaging with corresponding mounting posts 1611 of the housing 1. Each LED 40 includes an illuminating portion 43 and a pair of leads 42 extending rearwardly from the illuminating portion 43. Each foot contact 44 includes a carrier 442, a pair of solder bodies 443 extending downwardly from the carrier 442 and a pair of solder tails 444 respectively extending downwardly from a corresponding solder body 443. Each solder body 443 forms a stamped tab 441 extending rearwardly from a middle portion thereof, and thereby defining a corresponding hole 445 therein.

The LEDs 40 electrically connect to the circuit traces 416 by a rear end of each lead 42 soldered in a corresponding upper plated through hole 411. Leads 42 and illuminating portions 43 extend forwardly from the internal PCB 41. The foot contacts 44 are mounted on a lower portion of the internal PCB 41. Each tab 441 extends through a corresponding lower plated through hole 413 from one side of the internal PCB 41 and is bent over and against the other side of the internal PCB 41. The hole 445 is filled with solder, thereby soldering the tab 441 in the lower plated through hole 413 and electrically connecting the solder body 443 with a corresponding circuit trace 416. The carriers 442 are cut away thereafter. The solder tails 444 extend downwardly below a lower edge of the internal PCB 41 for being soldered in corresponding circuit traces on the mother PCB.

Figure 3:
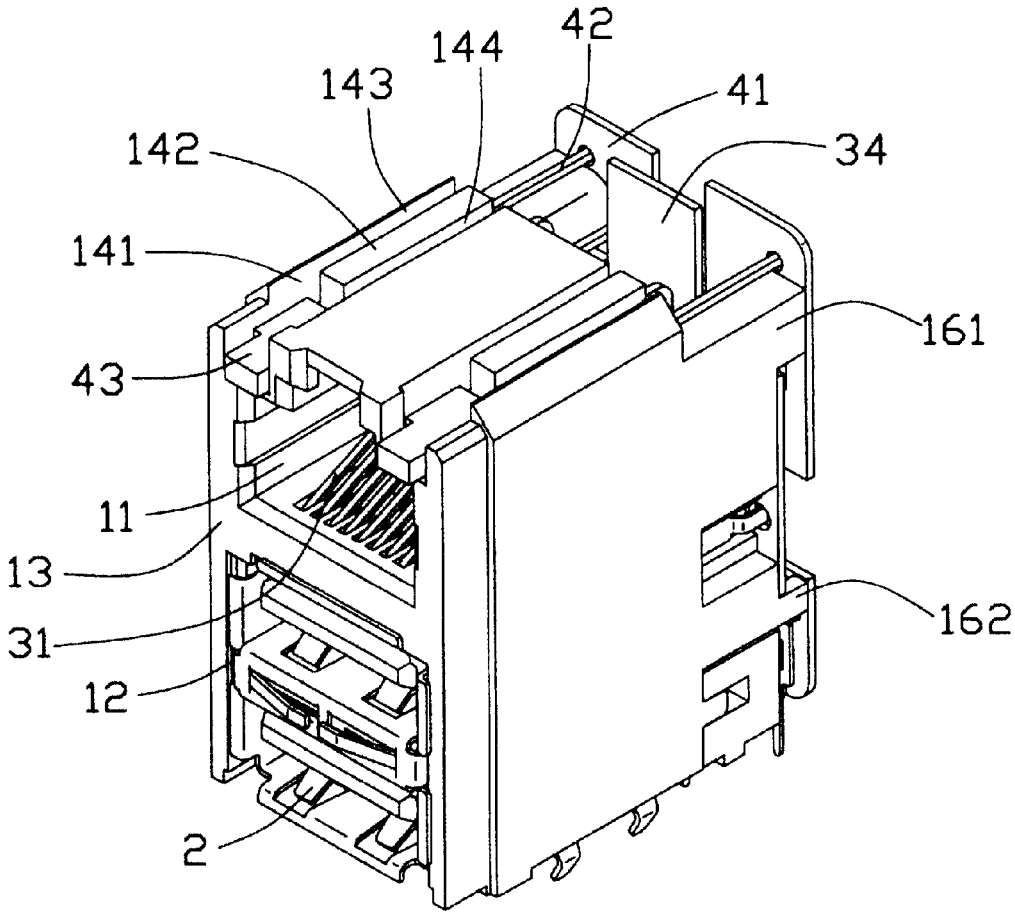
FIG. 3 is a partially assembled view of FIG. 1, wherein a shield is removed.
Figure 4:
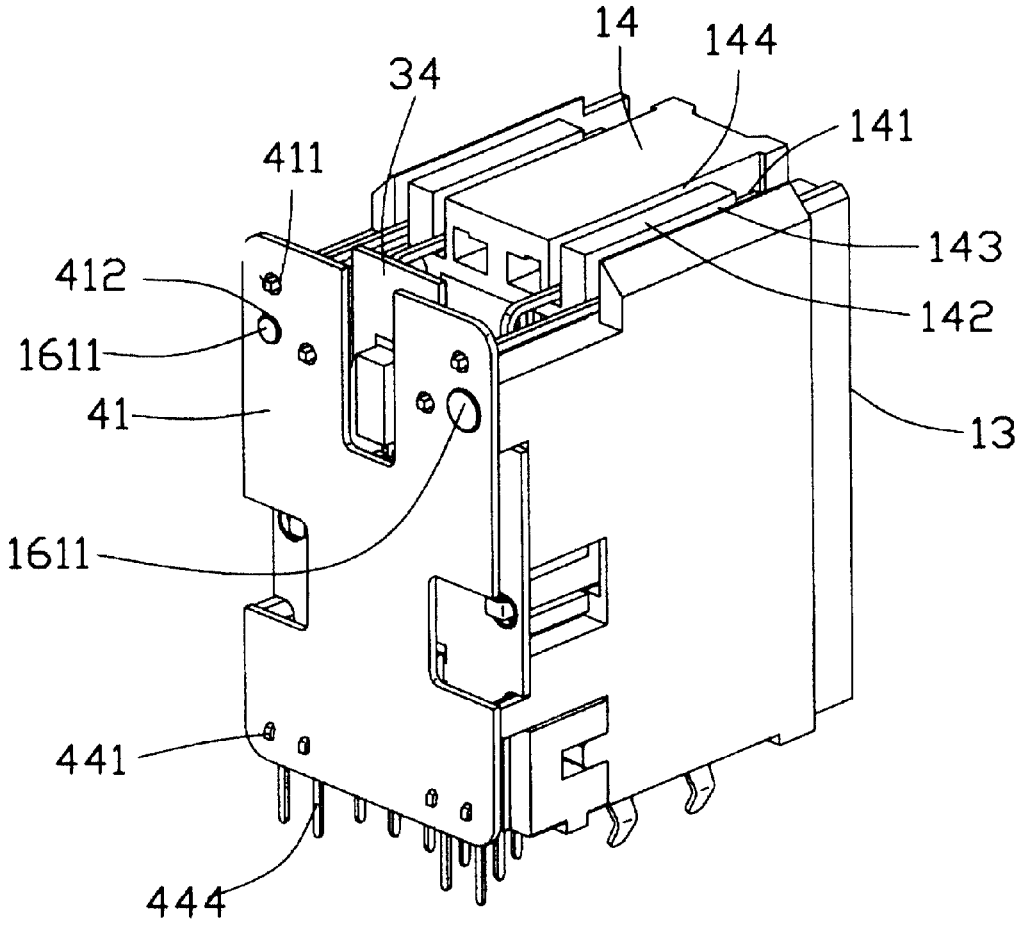
FIG. 4 is a partially assembled view of FIG. 2, wherein the shield is removed.

Referring to FIGS. 3 and 4, in assembly, the shielded USB connector 2 is received in the lower receiving slot 12 of the housing 1 for electrically engaging with mating USB plugs (not shown). The modular jack subassembly 3 is attached to a rear portion of the housing 1 with the conductive terminals 31 extending into the upper receiving slot 11 for electrically engaging with a mating modular plug (not shown). The daughter PCB 34 abuts against the rear face 15 of the housing 1. The LED subassembly 4 is mounted to a rear portion of the housing 1. The leads 42 are received in corresponding first and second channels 143, 144 and the illuminating portion 43 is received in a front portion of the slot 141 and is exposed to the mating face 13 of the housing 1. The mounting posts 1611 with different diameters are respectively engaged in corresponding mounting holes 412 of the internal PCB 41. The upper and lower mounting portions 161, 162 abut against the internal PCB 41, whereby the internal PCB 41 is spaced from the daughter PCB 34. Since the circuitry of the LEDs 40 is physically spaced from the circuitry of the daughter PCB 34, noise from the LEDs has less effect on the signal transmitting through the modular jack subassembly 3, thereby improving the modular jack's performance.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for being mounted to a mother Printed Circuit Board (PCB), comprising:

an insulative housing defining at least one receiving slot for receiving at least one mating connector;

a plurality of conductive terminals received in the insulative housing and partially extending into the at least one receiving slot; and an LED subassembly attached to the housing, the LED subassembly including an internal PCB electrically isolated from the conductive terminals before being mounted to the mother PCB and a pair of LEDs electrically mounted on the internal PCB and terminated to the mother PCB via the internal PCB;

wherein the internal PCB of the LED subassembly incorporates at least one pair of circuit traces, each LED includes leads soldered to the circuit traces;

wherein the internal PCB of the LED subassembly further carries resistors in the at least one pair of circuit traces;

wherein the LED subassembly includes foot contacts electrically connected to the circuit traces of the internal PCB;

wherein the internal PCB defines plated through holes, each foot contact includes a pair of solder bodies, each solder body forms a stamped tab extending rearwardly through a corresponding plated through hole from one side of the internal PCB and is bent over and against the other side of the internal PCB before soldering;

wherein each solder body of the foot contact defines a hole corresponding to the stamped tab and the hole is filled with solder for soldering the tab to the circuit trace of the internal PCB;

further including a daughter PCB carrying a plurality of resistors and capacitors and electrically connecting with the conductive terminals;

wherein the insulative housing includes opposite side walls and a rear face, at least one mounting portion extending rearwardly from the side walls, said daughter PCB and the internal PCB respectively abutting against the rear face of the housing and a rear face of the at least one mounting portion;

further including a magnetic module electrically connected to the daughter PCB.

* * * * *